United States Patent [19]

Ramohalli

[11] 4,210,474

[45] Jul. 1, 1980

[54] SILICONE CONTAINING SOLID PROPELLANT

[76] Inventor: Robert A. Frosch, Administrator of the National Aeronautics and Space Administration, with respect to an invention of Kumar N. R. Ramohalli, Pasadena, Calif.

[21] Appl. No.: 951,830

[22] Filed: Oct. 16, 1978

[51] Int. Cl.[2] ..... C06B 45/10

[52] U.S. Cl. ..... 149/19.2; 149/19.4; 149/19.9; 149/20

[58] Field of Search ..... 149/19.2, 19.9; 179/19.9, 20

[56] References Cited

U.S. PATENT DOCUMENTS

| | | | |
|---|---|---|---|
| 3,197,349 | 7/1965 | Kuhn et al. | 149/19.2 |
| 3,260,631 | 7/1966 | Witz et al. | 149/19.4 |
| 3,266,959 | 8/1966 | Ackley | 149/19.4 |
| 3,350,245 | 10/1967 | Dickinson | 149/19.2 |
| 3,715,246 | 2/1973 | Sayles | 149/19.2 |
| 3,781,179 | 12/1973 | Huskins et al. | 149/19.2 |
| 4,158,583 | 6/1979 | Frosch | 149/19.4 |

*Primary Examiner*—Edward A. Miller

*Attorney, Agent, or Firm*—Monte F. Mott; John R. Manning; Wilfred Grifka

[57] ABSTRACT

Addition of a small amount, for example 1% by weight, of a liquid silicone oil to a metal containing solid rocket propellant provides a significant reduction in heat transfer to the inert nozzle walls eliminating metal oxide slag collection and blockage of the nozzle and increases burning rate by about 5 to 10% improving ballistic performance.

8 Claims, No Drawings

SILICONE CONTAINING SOLID PROPELLANT

ORIGIN OF THE INVENTION

The invention described herein was made in the performance of work under a NASA contract and is subject to the provisions of Section 305 of the National Aeronautics and Space Act of 1958, Public Law 83-568 (72 Stat. 435; 42 USC 2457).

BACKGROUND OF THE INVENTION

1. Field of the Invention

The present invention relates to solid rocket propellants and, more particularly, to metal containing propellants having improved burning characteristics and burning rates.

2. Description of the Prior Art

Composite solid rocket propellants based on a dispersion of solid oxidizer in an organic binder have been formulated with a high content of combustible metal such as aluminum to maximize specific impulse and reduce combustion instability by forming solid particulates in the exhaust gases. However, these metal oxide particulates are found to form aluminum oxide slag which deposits and accumulates in the nozzle throat leading to decrease in effective throat area and finally to nozzle blockage, especially in the laboratory scale end burner units utilized in developmental programs.

Instability in solid propellant rocket motors continues to be a major problem in most, if not all, motor developmental programs. The term: "L* Instability" denotes various phenomena: chuffing, or intermittent combustion, bulk mode instability involving periodic oscillations superimposed on a mean chamber pressure, neither of which may have a constant value as time varies, and several combinations of these phenomena, including the depressurization rate (dp/dt) extinguishment. The L* mode of combustion instability appears to be, by far, the simplest of unstable operations. On account of this simplicity, and its intrinsic interest, L* instability as determined in standardized stainless steel L* motors with interchangeable stainless steel nozzles is currently the subject of extensive experimental effort. The troublesome blockage of L* or L-star motor small metal nozzles by metal oxide slags has interfered with testing of metallized propellants for L-star instability characteristics.

SUMMARY OF THE INVENTION

It has now been discovered in accordance with this invention that addition of a small amount, from 0.1 to 3% by weight of a liquid silicone oil to a metal containing solid rocket propellant provides a significant reduction in heat transfer to the inert nozzle walls eliminating or reducing metal oxide slag collection and blockage of the nozzle throat. Sophisticated testing, including the running of a series of pressure-time curves over a range of mean pressures and L* values, measuring temperatures at the nozzle throat, confirmed that significant reductions of heat transfer had occurred. This addition of about 1 wt.% of liquid silicone kept the test nozzle fairly clean and free of blockage for a significant interval. It has been further surprisingly discovered that the burning rate of these propellants is increased by about 5 to 10% providing improved ballistic performance.

These and many other features and attendant advantages of the invention will become apparent as the invention becomes better understood by reference to the following detailed description.

DESCRIPTION OF THE PREFERRED EMBODIMENTS

High energy, composite propellants usually contain a high proportion of combustible solids, typically in excess of 85% by weight, a small proportion of binder system generally from 10–14% by weight and small amounts below 15% of burning rate accellerators. The combustible solids generally comprise 70–84% by weight of an oxidizer such as ammonium perchlorate, ammonium nitrate, HMX, RDX or mixtures thereof and 2–20% of metal such as aluminum.

Preferred binders are elastomeric hydrocarbon polymers formed by the chain extension and cross-linking reactions of functionally terminated liquid polybutadiene polymers. Such polymers may include carboxy-terminated polybutadiene cured with amines or epoxides, polybutadiene acrylonitrile-acrylic acid terpolymers cured with epoxides, and hydroxy-terminated polybutadiene cured with diisocyanates. Hydroxy-terminated polybutadienes are preferred due to cost, reactivity, availability considerations and mechanical properties. The butadiene may be derived from the lithium initiated polymerization (Li-HTPB) or free radical initiated polymerization (FR-HTPB).

The composition may also contain a minor amount below 10% of various additives such as cure promotors, stabilizers and thixotropic control agents, or reactive polymeric modifiers such as one or more diols or polyols. The isocyanate is generally present in at least an equivalent amount sufficient to react with the hydroxy prepolymer and hydroxyl substituted modifiers.

The equivalent weight of the liquid prepolymer is at least 1,000 and not usually more than 2,500. The functionality of the polymer is advantageously from about 1.7 to about 3.0, preferably from about 1.9 to 2.3 to form by cross-linking and chain extending elastomeric polymers of molecular weight of at least 30,000. Since higher molecular weight prepolymers may require heat to reduce viscosity, the molecular weight is preferably from 1,000 to 2,500.

The polyisocyanate for curing the prepolymer can be selected from those of the general formula $(R(NCO)_m$ in which R is a di- or polyvalent organic radical containing from 2–30 carbon atoms and m is 2, 3 or 4. R can be alkylene, arylene, aralkylene or cycloalkylene. It is preferred that the organic radical be essentially hydrocarbon in character although the presence of unreactive groups containing elements other than carbon and hydrogen is permissible as is the presence of reactive groups which are not capable of reacting with isocyanate groups capable of forming urea or carbamate linkages such as to interfere with the desired reaction.

Examples of suitable compounds of this type include benzene-1,3-diisocyanate, hexane-1,6-diisocyanate, toluene-2,4-diisocyanate(TDI), toluene-2,3-diisocyanate, diphenylmethane-4,4'-diisocyanate, naphthylene-1,5-diisocyanate, diphenyl-3,3'-dimethyl-4,4'-diisocyanate, diphenyl-3,3'-dimethoxy-3,3'-diisocyanate, diphenyl-3,3'-dimethoxy-4,4'-diisocyanate, butane-1,4-diisocyanate, cyclohex-4-ene-1,2-diisocyanate, benzene-1,3,4-triisocyanate, naphthylene-1,3,5,7-tetraisocyanate, metaphenylene diisocyanate (MDI), isophorone diicyanate (IPDI), isocyanate terminated prepolymers, polyaryl polyisocyanates and the like.

Polyols are preferably, but not limited to, diols or triols and can be either saturated or unsaturated aliphatic, aromatic or certain polyester or polyether products. Exemplary compounds include glycerol, ethylene glycol, propylene glycol, neopentylglycol, pentaerythritol, trimethylolethane, glycerol triricineolate, or alkylene oxide adducts of aniline such as Isonol which is N,N-bis-(2-hydroxypropyl) aniline and many other polyols well known in the art which can be incorporated into the binder composition to control the degree of cross-linking. The particular compound and amount utilized is dependent on the functionality and nature of the hydroxyl terminated prepolymer and polyisocyanate employed in the binder composition.

Since the functionality of Li-HTPB is generally slightly less than 2, the polyol is preferably a triol so as to provide cross-linking between polymeric chains upon reaction with isocyanates. As exemplary polyols, mention may be made of glycerol triricinoleate (GTRO) and Isonol (a propylene oxide adduct of aniline), N,N-bis-(2-hydroxypropyl)-aniline. The polyisocyanate is present in an amount necessary to satisfy stoichiometry, that is, the functionality of the HTPB and any other polyol present in the composition. The polyisocyanate may be a di-, tri- or higher functional material and may be aliphatic in nature such as hexanediisocyanate but is preferably an aromatic polyisocyanate such as TDI. A catalytic cure promoting agent can be utilized. These agents may be metal salts such as metal acetylacetonates, preferably thorium acetylacetonate (ThAA) or iron acetylacetonate (FeAA).

The silicone oils are liquids having a viscosity from 500 to 2,000 centistokes (cs). The silicones are polysiloxanes of the formula:

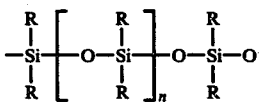

where R is a hydrocarbon group, generally alkyl of 1 to 5 carbon atoms such as methyl.

The following propellant compositions were prepared:

TABLE 1

| Ingredient | Weight Percentage Ex. 1 | Ex. 2 |
|---|---|---|
| Unground AP (ammonium perchlorate) | 49.00 | 49.00 |
| Ground AP | 21.00 | 21.00 |
| Aluminum (Alcoa 1230) | 14.00 | 14.00 |
| Silicone Oil (1000 cs) | 1.00 | |
| HTPB prepolymer | 13.98 | 14.912 |
| IPDI | 1.02 | 1.088 |

The L-star burner used in these experiments is a 2.5 inch diameter stainless steel cylindrical chamber that has its two ends covered with the nozzle end plate captioned and the piston end plate. The piston end plate has a threaded rod passing through it, at the end of which is a stainless steel piston of 2.5 inch diameter.

The propellant to be tested is bonded before each run to this piston. The pressure is sealed by the two O-rings. The nozzle is a stainless steel piece that is machine contoured, and screwed into the nozzle end plate with a pressure seal. Nozzles of various throat diameters can be used interchangeably with ease. The position of the piston in the chamber determines the chamber free volume ($V_c$) and is preset with the use of a lock nut. The motor is mounted rigidly on a table with a one-inch (heavy wall) tube stock of short length. The exhaust is to the atmosphere (usually 14.3 psia).

The pressure in the chamber is measured continuously during a run by one of the Teledyne Taber gages (strain gage type), different ones being used for different pressure ranges of interest. The pressure tap is a ⅛-inch hole that communicates with the chamber. The electrical output from the gage was amplified by an amplifier of the Dynamics type (Instrumentation Co. Model 6122), and recorded on one channel of an oscilloscope. Because the highest frequency encountered was about 100 Hz., the frequency response of the instrumentation was not a limiting factor.

The ignition procedure employed was the well-known X-225 igniter paste which is applied in a thin layer over the surface of the propellant, and a pellet of the X-225 (teardrop), at the center of which is a Nichrome heater wire, is bonded to the center of the surface. The size of the pellet and the thickness of the surface layer have known effects on the nature of the test run. These two variables have to be carefully tailored to meet requirements of each particular run. The igniter leads (copper) from the Nichrome wire are led out through the nozzle, and are hooked up to a 28 volt D.C. power supply.

At the end of each run, even if the propellant is not fully consumed, the chamber free volume is determined by filling the chamber with water, up to the throat of the nozzle.

In many of the earlier runs, before silicone oil was formulated as a component, aluminum oxide slag, from the aluminum metal in the propellant, continuously accumulated on the nozzle surface, and as a result the effective throat area decreased continuously during the run. The undesirability of such a phenomenon was clearly indicated by the rising pressures.

Example 2 is the control batch thought to represent a typical state-of-the-art metallized AP/Composite propellant. Example 1 propellant is the new silicone propellant with 1% silicone oil added at the expense of the binder. The propellants were fired in the 2½" I.D. end burning L-star motor. The burner and a set of interchangeable contoured nozzles are constructed of stainless steel for ease and convenience in the laboratory bench firings. Continuous pressure histories in the motors were recorded on an oscilloscope with the pressure measured by Teledyne Taber gages.

Some of the nozzles were instrumented with Pt-Pt/10 Rh thermocouple with its sensor lead practically at the nozzle throat. Continuous temperature histories were obtained in firings with this instrumentation.

At the end of each firing the free volume in the motor was measured. Thus a record of L-star values versus time to accompany the pressures and nozzle throat temperatures are also obtained.

Even with the small percentage of silicone oil additive in the propellant significant changes are observed in the pressure time and temperature time histories. There exists a maximum nozzle throat diameter above which no blockage is observed; that is, the relative heat loss to the inert walls is sufficiently small to preclude the condensation of alumina on them. The heat loss rate to the inert walls is less with the silicone oil additive in the propellant than with the control propellant (with no silicone oil). Even when the blockage does occur with the silicone propellant, there is a distinct difference in the two propellants. The nozzle blockage starts almost immediately after the ignition and continues steadily during the run in the control propellant (Ex. 2). Whereas, with the silicone oil containing propellant (Ex. 1), the nozzle is fairly clean for approximately 5–6 seconds and the condensation starts abruptly. It would appear that the silicone oil addition reduces the heat transfer rate to the inert nozzle wall considerably. The propellant of Example 1 showed practically no blockage in 70% of the firings (compared with 21% for the control prior art propellant (Example 2). Propellant burning rates surprisingly are increased by about 5 to 10%.

In earlier experiments, the following composition was burned in the end burner unit as is and after coating the surface of the throat with 1000 cs silicone oil.

TABLE 2

| Ingredient | Weight Percentage |
|---|---|
| Unground AP | 49.00 |
| Group AP | 21.00 |
| PBAN* binder system (PBAN77 & Epon 828) | 14.00 |
| Aluminum (Alcoa 1230) | 16.00 |

*PBAN is a terpolymer of butadiene, acrylonitrile and acrylic acid generally containing an average of two carboxyl groups per molecule and an average of 6% by weight of cyano groups.

The run without oil resulted in continuous accumulations of slag on the nozzle surface and concomittant decrease in effective throat area. The application of silicone oil directly to the interior nozzle surface before run, was extremely effective in reducing the slag buildup, at least for the run durations of interest in propellant research work usually of the order of 10 seconds.

It is to be realized that only preferred embodiments of the invention have been described and that numerous substitutions, modifications and alterations are permissible without departing from the spirit and scope of the invention as defined in the following claims.

What is claimed is:

1. A composite solid propellant comprising a continuous phase of 10 to 14% by weight of cured, solid elastomeric polybutadiene binder containing 0.1 to 3% by weight of a polysiloxane liquid oil having a viscosity from 500 to 2,000 centistokes of the formula:

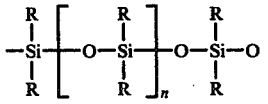

where n is an integer and R is an alkyl of 1 to 5 carbon atoms and said binder contains a dispersion of in excess of 85% by weight of combustible solids including metal and oxidizer.

2. A propellant according to claim 1 in which the oxidizer is present in an amount from 70–84% by weight and the metal is present in an amount from 2 to 20% by weight.

3. A propellant according to claim 2 in which the metal is aluminum and the oxidizer is ammonium perchlorate.

4. A propellant according to claim 3 in which the polybutadiene is selected from carboxy-terminated polybutadienes cured with amines or epoxides, PBAN terpolymers cured with epoxides or hydroxyl-terminated polybutadienes cured with diisocyanates.

5. A composition according to claim 4 in which the diisocyanate is isophorone diisocyanate.

6. A composition according to claim 1 in which the silicone oil is a polydimethylsiloxane.

7. A composition according to claim 6 in which the siloxane has a viscosity of about 1000 cs.

8. A method of reducing aluminum oxide slag deposition in the nozzle of a solid rocket motor containing a high performance solid propellant grain including 10 to 14% by weight of cured, solid elastomeric polybutadiene binder containing a dispersion of in excess of 85% by weight of combustible solids including metal and oxidizer, the improvement comprising the steps of adding to the binder from 0.1% to 3% by weight of a polysiloxane liquid oil having a viscosity from 500 to 2,000 centistokes of the formula:

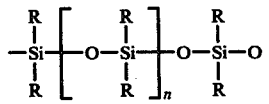

where n is an integer and R is an alkyl of 1 to 5 carbon atoms and said binder contains a dispersion of in excess of 85% by weight of combustible solids including metal and oxidizer.

* * * * *